US010418714B2

(12) United States Patent
Liao et al.

(10) Patent No.: US 10,418,714 B2
(45) Date of Patent: Sep. 17, 2019

(54) ELECTRONIC SWITCHING BEAMFORMING ANTENNA ARRAY

(71) Applicant: Chunghwa Telecom Co., Ltd., Yangmei, Taoyuan County (TW)

(72) Inventors: Wen-Jiao Liao, Yangmei (TW); Yan-Yun Lin, Yangmei (TW); Chang-Fa Yang, Yangmei (TW); Chang-Lun Liao, Yangmei (TW)

(73) Assignee: Chunghwa Telecom Co., Ltd., Yangmei (TW)

( * ) Notice: Subject to any disclaimer, the term of this patent is extended or adjusted under 35 U.S.C. 154(b) by 197 days.

(21) Appl. No.: 15/439,277

(22) Filed: Feb. 22, 2017

(65) Prior Publication Data

US 2018/0019519 A1 Jan. 18, 2018

(30) Foreign Application Priority Data

Jul. 12, 2016 (TW) ..... 105121998 A

(51) Int. Cl.

| | |
|---|---|
| ***H01Q 13/10*** | (2006.01) |
| ***H01Q 1/48*** | (2006.01) |
| ***H01Q 21/06*** | (2006.01) |
| ***H01Q 3/24*** | (2006.01) |
| ***H01Q 21/00*** | (2006.01) |
| ***H01Q 5/307*** | (2015.01) |

(52) U.S. Cl.

CPC ..... *H01Q 13/10* (2013.01); *H01Q 1/48* (2013.01); *H01Q 3/24* (2013.01); *H01Q 5/307* (2015.01); *H01Q 21/0006* (2013.01); *H01Q 21/064* (2013.01)

(58) Field of Classification Search

CPC ..... H01Q 1/48; H01Q 13/10; H01Q 21/0006; H01Q 21/064; H01Q 3/24; H01Q 5/307

See application file for complete search history.

(56) References Cited

U.S. PATENT DOCUMENTS 3,604,012 A * 9/1971 Lindley ..... H01Q 3/38 342/371
5,977,924 A * 11/1999 Takei ..... H01Q 21/068 343/700 MS
6,424,298 B1 * 7/2002 Nishikawa ..... H01Q 21/064 343/700 MS

* cited by examiner

*Primary Examiner* — Hai V Tran
*Assistant Examiner* — Michael M Bouizza
(74) *Attorney, Agent, or Firm* — Amin, Turocy & Watson LLP

(57) ABSTRACT

In an electronic switching beamforming antenna array, a coplanar feeding line of the antenna array is configured on a metal plane of a substrate, and a plurality of slot antennas of aforementioned antenna array are inclinedly configured on the metal plane and configured on at least one side of the coplanar feeding line. A slot coupling segment of slot antenna is configured at one end of the slot antenna and neighbored with the coplanar feeding line so as to make the slot antenna couple with the coplanar feeding line, and a switch device of the slot antenna is configured at one portion which between one part of the slot antenna and a grounding plane formed by the metal plane. When the switch device is triggered to configure a radiating feature of the slot antenna, the antenna array is able to achieve the purpose of setting beamforming direction.

11 Claims, 15 Drawing Sheets

ELECTRONIC SWITCHING BEAMFORMING ANTENNA ARRAY

BACKGROUND OF THE INVENTION

This application claims priority benefit of TW Patent Application Ser. No. 105121998 filed Jul. 12, 2016 which is hereby incorporated herein by reference its entirety.

1. Field of the Invention

This invention relates to an antenna array, in particular referring to an electronic switching beamforming antenna array.

2. Description of the Prior Art

Among the new generation communication systems, many systems use adjustable beamforming antenna arrays to adjust the beamforming directions of the radiating field patterns so as to effectively allocate the wireless bandwidth in free space and the power of the wireless communication.

Conventional adjustable beamforming antenna arrays can accomplish this through passive solutions and active solutions. The passive solutions mostly use the Butler Matrix in conjunction with electronic switches to generate electronic pulses of different phases and provide feed to the antenna ends to achieve the aims of adjusting the beams. However, as the Butler Matrix has a large volume, the installation of passive adjustable beam antenna arrays is often restricted.

The active solutions, on the other hand, involve the fitting of a phase controller on the front of specific antennas and use the calibration of the phases and amplitude of the antennas to adjust the beam direction of the antenna array. As the production process of the phase controller involves a high level of complexity, the costs of producing adjustable beam antenna arrays remain high.

Based on the aforementioned, finding an antenna array that can provide adjustable beam directions and solve the aforementioned difficulties is a technical issue that requires solving in this field.

SUMMARY OF THE INVENTION

In order to solve the aforementioned issues, the aim of this invention relates to providing an antenna array that allows controllable beamforming direction.

To achieve the aforementioned aims, this invention proposes a type of antenna array that uses electronic switches for beamforming. The aforementioned antenna comprises a coplanar feed line and a plurality of slot antennas. The coplanar feed line of the antenna array is configured on a metal plane of a substrate, and the plurality of slot antennas of the antenna array are inclinedly configured on the metal plane and configured on at least one side of the coplanar feed line. Each slot antenna comprises a slot coupling segment and a switch device. The slot coupling segment is configured on one end of the slot antenna and neighbored with the coplanar feed line so as to allow the slot antenna couple with the coplanar feed line. The switch device of the slot antenna is configured on one portion between one part of the slot antenna and a grounding plane formed by the metal plane. The switch device can be triggered to configure a radiating feature of the slot antenna to set the beamforming direction of the antenna array.

Based on the aforementioned, in comparison to the complex structure of the aforementioned antenna arrays, the invention provides an antenna array structure that is more concise and the user end can trigger the switch device to effectively adjust the beamforming direction.

BRIEF DESCRIPTION OF THE DRAWINGS

For a better understanding of the aforementioned embodiments of the invention as well as additional embodiments thereof, reference should be made to the Description of Embodiments below, in conjunction with the following drawings in which like reference numerals refer to corresponding parts throughout the figures.

DETAILED DESCRIPTION OF THE PREFERRED EMBODIMENT

The following description is about embodiments of the present invention; however, it is not intended to limit the scope of the present invention.

Figure 1:
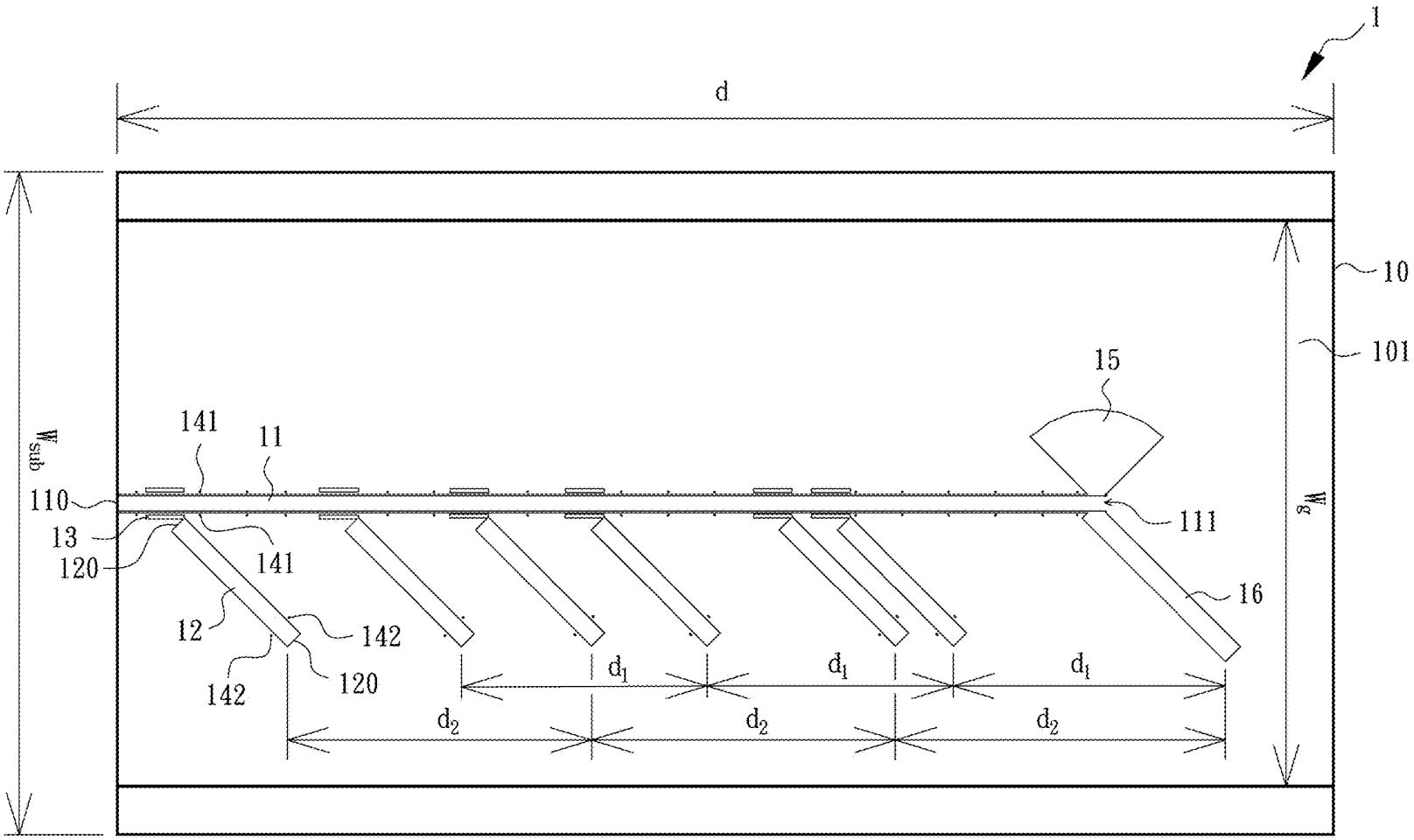
FIG. 1 relates to a structural schematic of an electronic switching beamforming antenna array in the first embodiment of the invention.

Please refer to FIG. 1 which is the structural schematic of the electronic switching beamforming antenna array 1 in the first embodiment of the invention. The aforementioned electronic switching beamforming antenna array 1 comprises coplanar feed line 11 and a plurality of slot antenna 12. The coplanar feed line 11 is configured on the substrate 10 of the first plane 101 (metal) while the slot antennas 12 are inclinedly configured on the first plane 101 (metal plane) and configured on at least one side of the coplanar feed line 11.

Figure 2:
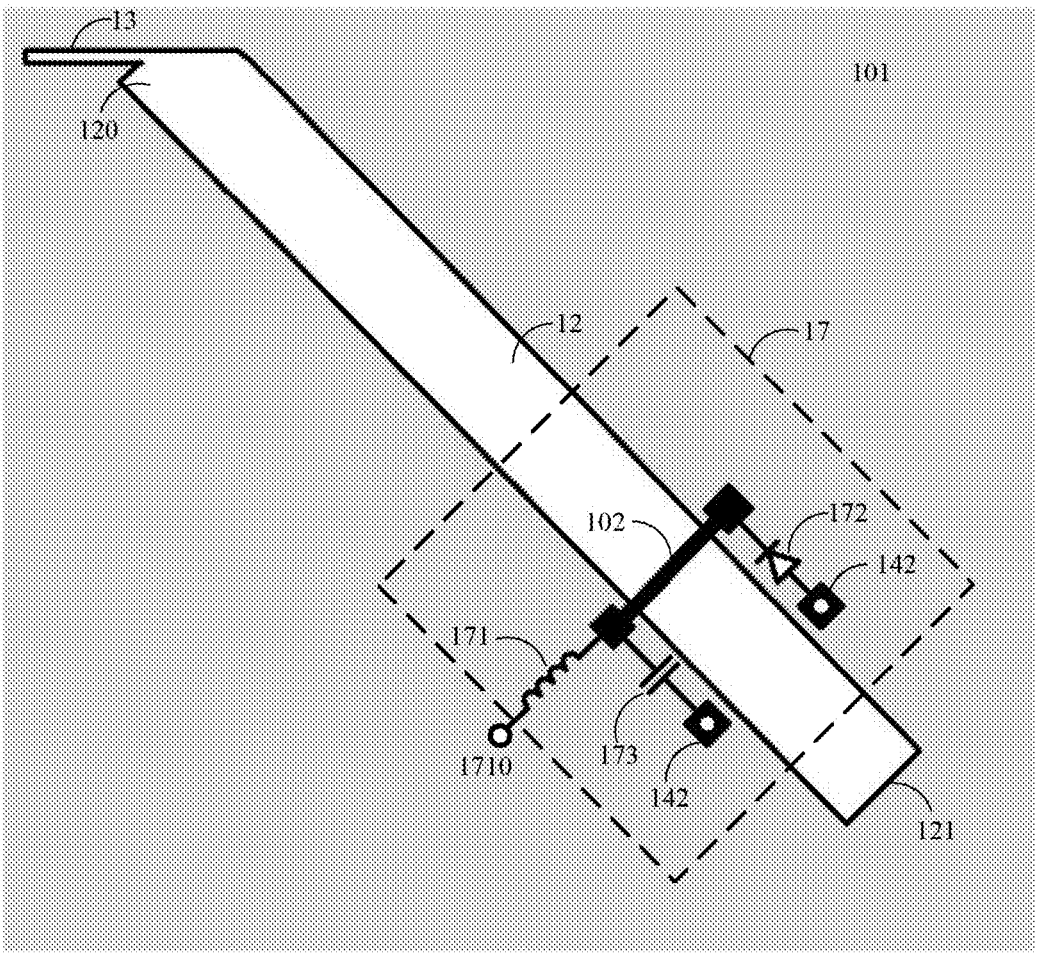
FIG. 2 and FIG. 3 are schematics of a single slot antenna.

The slot antenna 12 further comprises slot coupling segment 13 and switch device 17 (FIG. 2). The slot coupling segment is configured on one end of the slot antenna 12 and neighbored with the coplanar feed line 11 so as to allow the coupling connection between slot antenna 12 and the coplanar feed line 11. The switch device 17 is configured at one portion between one part of the slot antenna (near the antenna terminal 121) and a grounding plane formed by the metal plane (connected from the second through hole 142 to the metal plane of the first plane 101). The slot antenna 12 can adjust the frequency bands through the setting of the geometric length or the location of the switch device 11 on the slot antenna 12.

In order to increase the directionality of the antenna, reflective devices (such as metal plates) can be installed at a certain distance from the second plane (FIG. 2, reverse side of the first plane 101) of the substrate 10 to increase the directionality of the antenna.

The aforementioned slot antenna 12 is formed from the extension of the coplanar feed line 11 towards the terminal 111 of the coplanar feed line 11. The angle between slot antenna 12 and the coplanar feed line 11 is used to calibrate the polarization characteristics. In another embodiment, the angle can be adjusted to 45 degrees or near 45 degrees, or based on the requirements of the user end.

When the switch device 17 is enabled, the radiating features of the slot antenna can be configured to adjust the beamforming direction of the antenna array. To further explain, when the switch device 17 is triggered and connected, the connecting areas of slot antenna 12 and switch device 17 will be connected to the ground, and will change the radiating length of the slot antenna 12 (the length from antenna feed line end 120 to the location of the switch device 17) which will change the radiating efficiency of specific bands of the slot antenna 12, or calibrate the working frequency of the slot antenna 12.

Figure 3:
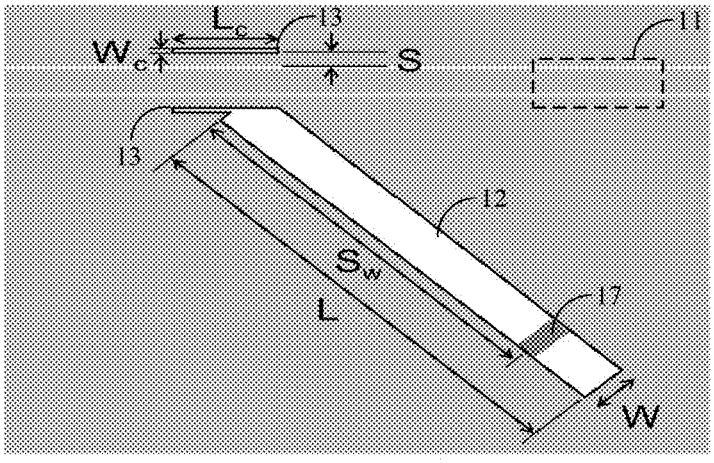

Please refer to FIG. 2 and FIG. 3, which are the schematic drawings of a single slot antenna. The longitudinal axes of the aforementioned slot coupling segment 13 are parallel with the longitudinal axis of the coplanar feed line 11. In another embodiment, the slot coupling segment 13 is a rectangular slot, and forms a slot structure with one end of the inclinedly configured slot antenna 12. The aforementioned slot coupling segment 13 can be used to impede the slot antenna 12 and the coplanar feed line. In addition, the user end may use a distance between the coplanar feed line 11 and the slot coupling segment 13, and the length and width of the slot coupling segment 13 to adjust the coupling amount and resonance frequency etc.

The aforementioned switch device 17 may be achieved through the use of the radio frequency switch and radio frequency diode 172. In another embodiment, the aforementioned switch device 17 may be accomplished by an equivalent switch formed from the radio frequency diode 172, capacitor 173, and bias inductor 171. The aforementioned devices are configured on the second plane 102 (reverse side) of the substrate 10. One end of the bias inductor 171 is connected to the bias end 1710 (such as the control port of the control circuit) while the other end of is connected to one end of the capacitor 173 and radio frequency diode 172. The capacitor 173 and the other end of the radio frequency diode are connected to the ground plane of the first plane 101 via the second through hole 142. When the bias inductor 171 is used to provide a DC voltage, the radio frequency diode 172 can be conducted to calibrate the radiating features of the slot antenna so as to configure the operation of each slot antenna 12 (adjusting the radiating length and operating band of the antenna).

The terminal 111 of the coplanar feed line 11 further comprises an opening slot element 15 and a terminal slot antenna 16. When the signal generated from the feed terminal 110 of the coplanar feed line 11 is sent to terminal 111, the signal will be affected by the opening slot element 15, and the signal current will flow towards the terminal slot antenna 16. In the first embodiment, the opening slot element 15 uses a fan-shaped opening slot element, and the expansion angle of the fan shape is 90 degrees, with length approximately at ¼ of the operating frequency wavelength (16.72 mm). The length of the terminal slot antenna 16 is 42 mm, and the width is 4.3 mm. The aforementioned opening slot element 15 and the terminal slot antenna 16 are configured on both sides of the coplanar feed line 11, respectively.

In order to connect to the ground plane isolated by the coplanar structure, the two sides of the coplanar feed line 11 are installed with first through hole 141 and the first through hole 141 of both sides are connected via wires. In another embodiment, the aforementioned wires are installed on the second plane 102 (not illustrated in drawing) of the substrate.

The aforementioned serial connected slot antennas 12 are interleavedly configured into a plurality of antenna groups by spacing. When the working frequency is operating within the range of 2500 MHz~2690 MHz, the substrate 10 is glass fiber (FR4), the radio frequency diode 172 is the SMP1345 079LF PIN DIODE by Skyworks company, the capacitance of capacitor 173 is 2.4 pF, and the inductance of the bias inductor is 12 nH, then the parameters in FIG. 1~FIG. 3 are as shown in Table 1 and Table 2 below:

TABLE 1

| Geometric Parameters of Antenna | | | | | | | | |
|---|---|---|---|---|---|---|---|---|
| $W_g$ | $W_{sub}$ | H | L | W | $S_w$ | $L_c$ | $W_c$ | S |
| 117 | 137 | 30 | 34 | 3.8 | 28 | 8 | 0.8 | 0.3 |

(Unit: mm)

TABLE 2

| Geometric Parameters of Antenna | | |
|---|---|---|
| d | $d_1$ | $d_2$ |
| 259 | 51 | 63 |

(Unit: mm)

where, Wg is the width of the first plane 101 (metal plane) of the substrate 10, Wsub is the width of the substrate 10, d is the length of the substrate 10, H is the distance from the substrate 10 to the reflective device (in the direction of the second plane 102, not illustrated in drawing), L is the length of the slot antenna 12, W is the width of the slot antenna 12, Sw is the length from antenna feed line end 120 of the slot antenna 12 to the switch device 17, Lc is the length of the slot coupling segment 13, We is the width of the slot coupling segment 13, S is the distance from the slot coupling segment 13 to the coplanar feed line 11, and d1 and d2 are the spacing between each antenna group.

In the first embodiment, the aforementioned serial connected slot antennas 12 are interleavedly configured into a plurality of antenna groups by spacing, and the spacing d1 is defined as State 2 of the antenna group of the slot antennas 12, and the spacing d2 is defined as State 1 of the antenna group of the slot antennas 12. Through the triggering of the switch device 17 of the antenna groups, the aim of controlling the beamforming can be achieved.

Figure 4:
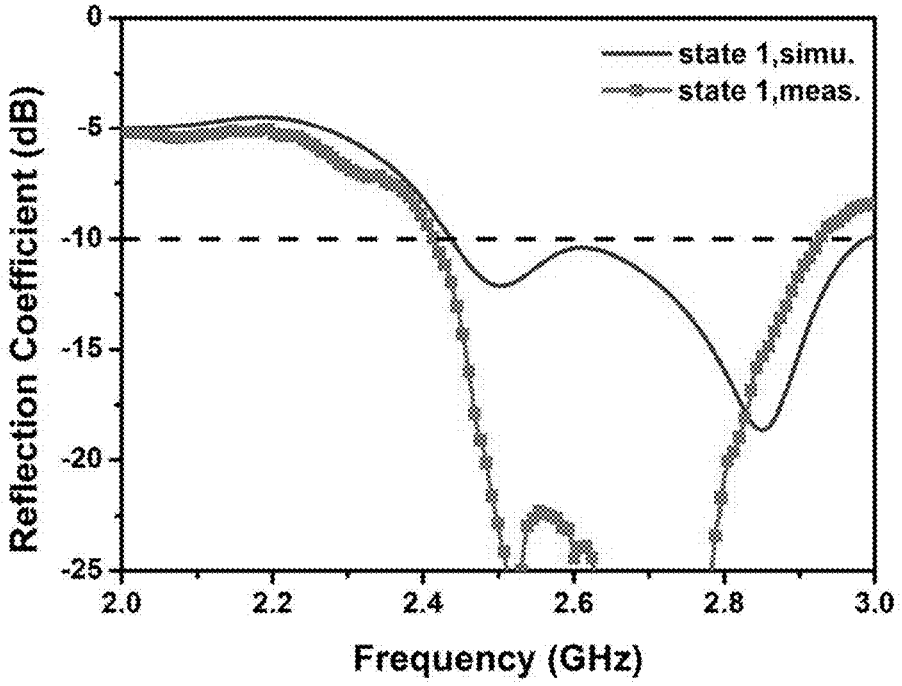
FIG. 4 and FIG. 5 show simulation diagrams and actual measurement charts of the return loss during State 1 and State 2 of the electronic switching beamforming antenna array in the first embodiment of the invention respectively.
Figure 5:
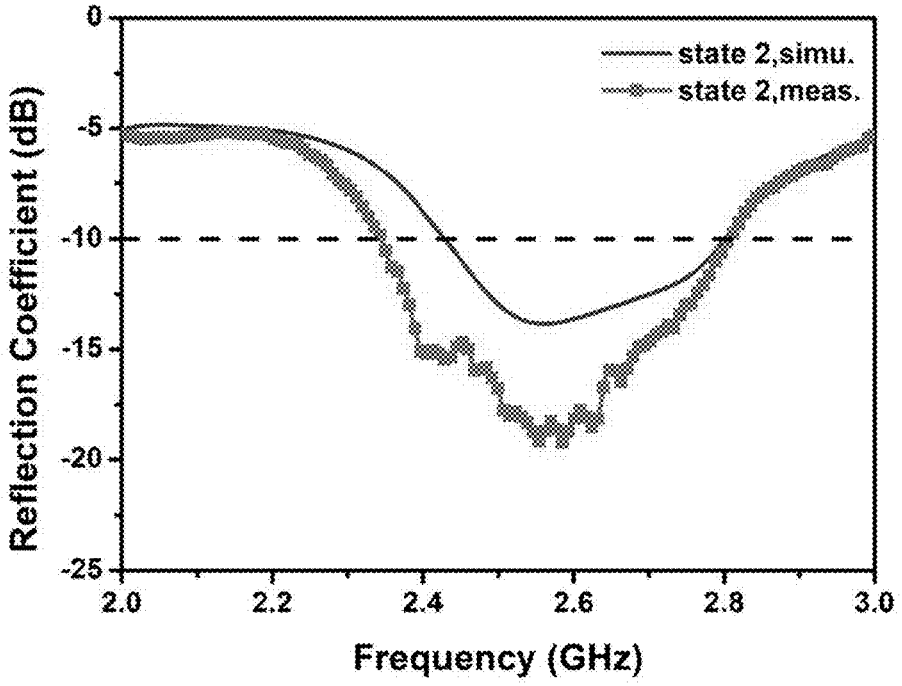

Please refer to FIG. 4 and FIG. 5, which are the simulation diagrams (smooth line section) and actual measurement charts (Square node section) of the return loss during State 1 and State 2 of the electronic switching beamforming antenna array in the first embodiment of the invention, respectively. From FIG. 4 and FIG. 5, it is proven that the antenna in the first embodiment can be operated within the range of 2500 MHz~2690 MHz.

Figure 6:
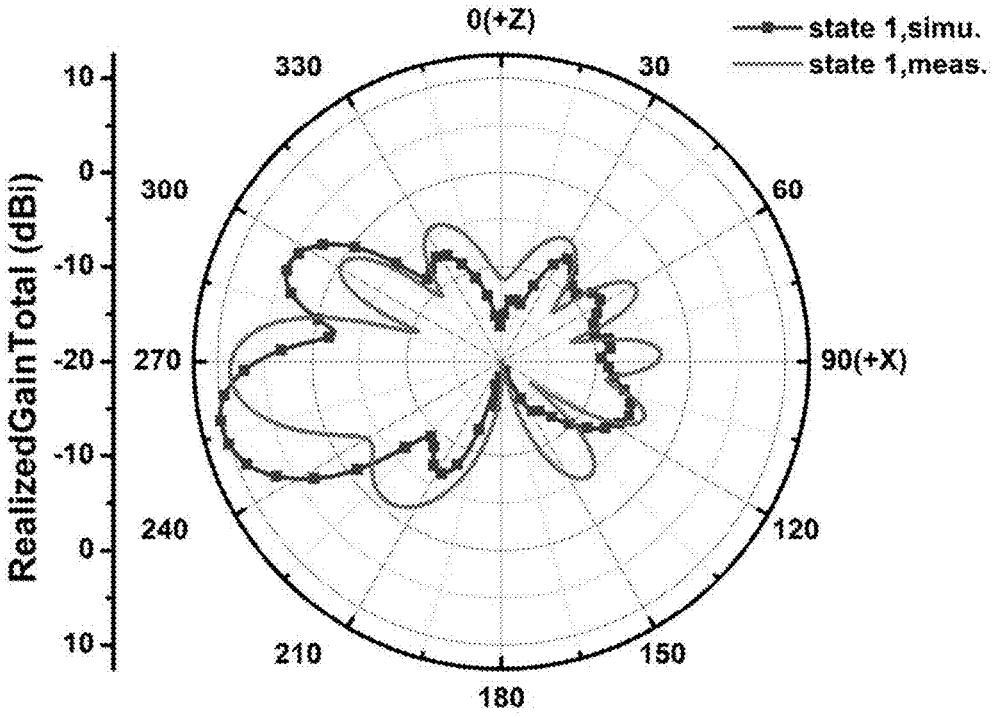
FIG. 6 and FIG. 7 are a simulation diagram and an actual measurement chart of the XZ plane (vertical plane) during State 1 and State 2 of the electronic switching beamforming antenna array in the first embodiment of the invention respectively.
Figure 7:
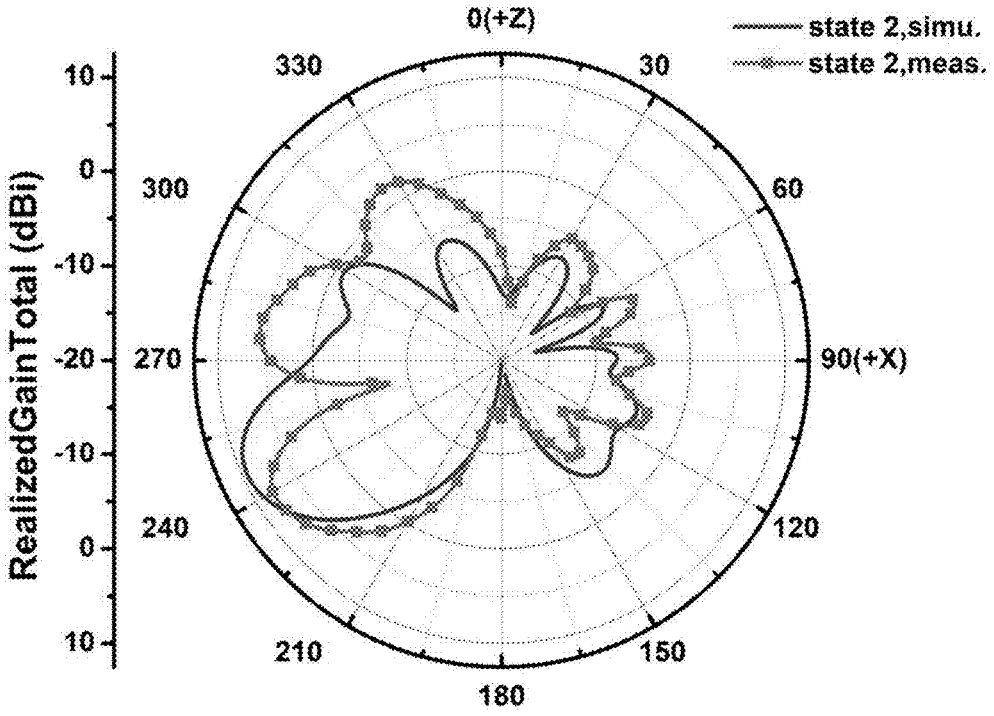

Please refer to FIG. 6 and FIG. 7, which are the simulation diagrams and actual measurement charts of the XZ plane (vertical plane) during State 1 and State 2 of the electronic switching beamforming antenna array in the first embodiment of the invention, respectively. In State 1, the simulation diagram shows a square node section and the measurement chart shows a smooth line section. In State 2, the simulation diagram shows a smooth line section and the measurement chart shows a square node section. From FIG. 6 and FIG. 7, it can be proven that the antenna in the first embodiment possesses the ability to change beamforming direction. The parameters of the electronic switching beamforming antenna array 1 in State 1 and State are as shown in Table 3:

TABLE 3

| | Maximum Gain (dBi) | | Efficiency (%) | | Vertical Plane Tilt Angle of Main Beam (deg) | | Vertical Plane 3 dB Beam Width (deg) | | Horizontal Plane 3 dB Beam Width (deg) | |
|---|---|---|---|---|---|---|---|---|---|---|
| | Simulated Value | Measured value | Simulated Value | Measured value | Simulated Value | Measured value | Simulated Value | Measured value | Simulated Value | Measured value |
| State 1 | 9.14 | 10.70 | 54.29 | 72.60 | 2 | 13 | 20 | 23 | 76 | 75 |
| State 2 | 10.73 | 9.86 | 63.43 | 74.76 | 24 | 32 | 26 | 25 | 58 | 84 |

Figure 8:
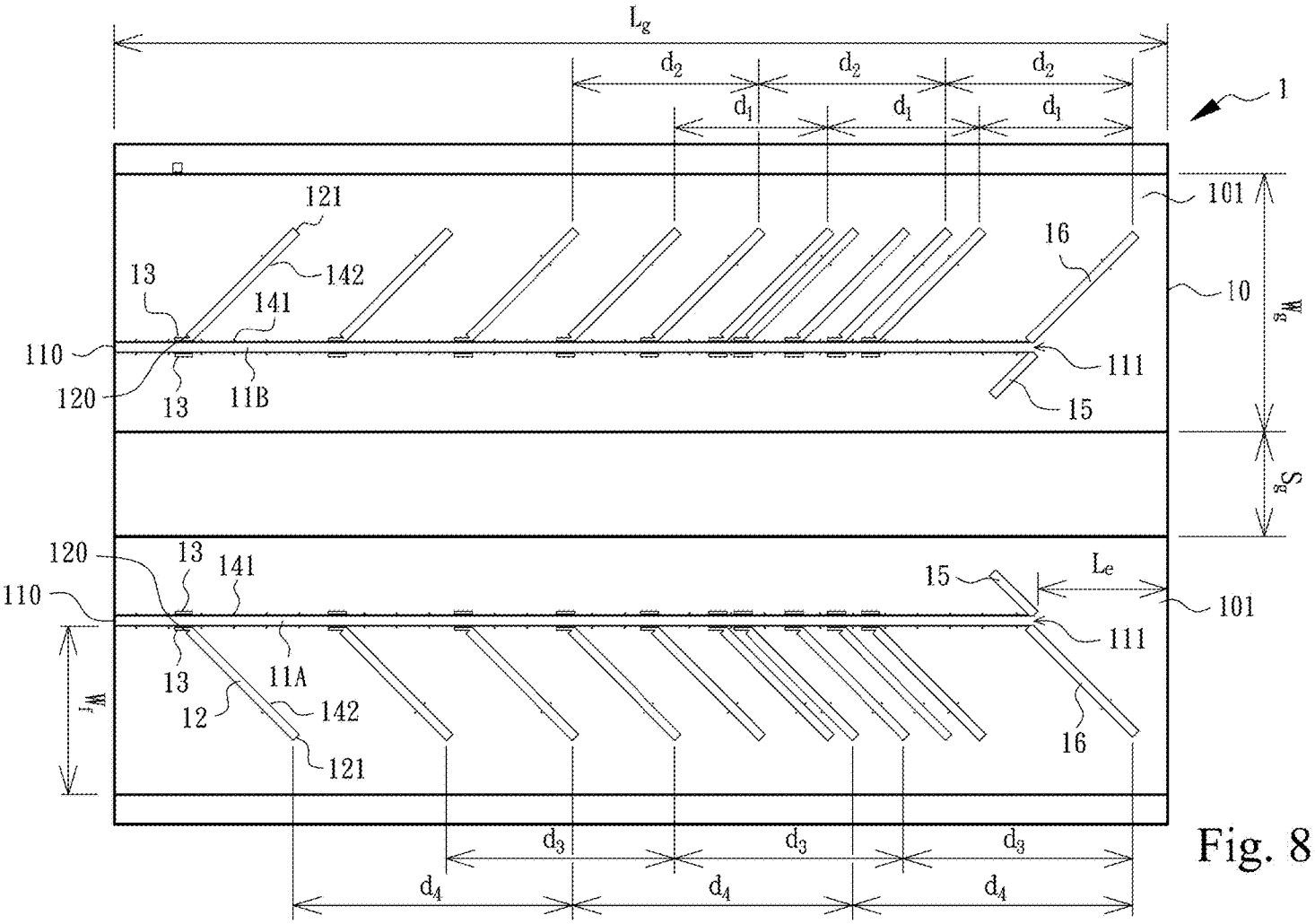
FIG. 8 is a structural schematic of the electronic switching beamforming antenna array in the second embodiment of the invention.

Please refer to FIG. 8, which is the structural schematic of the electronic switching beamforming antenna array in the second embodiment of the invention. The second embodiment is similar to the first embodiment. A difference lies in the coplanar feed line 11 of the second embodiment, which further comprises a first coplanar feed line 11A and a second coplanar feed line 11B, and a slot antenna 12 is installed on one side of the first coplanar feed line 11A and the second coplanar feed line 11B, respectively. The slot antennas 12 of the aforementioned coplanar feed line 11A and the second coplanar feed line 11B can adjust the geometric lengths between each antenna group so as to allow the electronic switching beamforming antenna array to possess at least one operating frequency band. In this embodiment, the electronic switching beamforming antenna array 1 is configured to allow operation in dual frequency bands. The geometric dimensions and parameters of the antenna are as shown in Table 4.

TABLE 4

Geometric Dimensions and Parameters of Antenna

| $L_g$ | $W_g$ | $S_g$ | $W_f$ | $L_e$ | S | $d_1$ | $d_2$ | $d_3$ | $d_4$ |
|---|---|---|---|---|---|---|---|---|---|
| 356 | 87 | 35.2 | 58.5 | 45.05 | 0.3 | 51.48 | 63 | 77.22 | 94.5 |

(Unit: mm)

Figure 9:
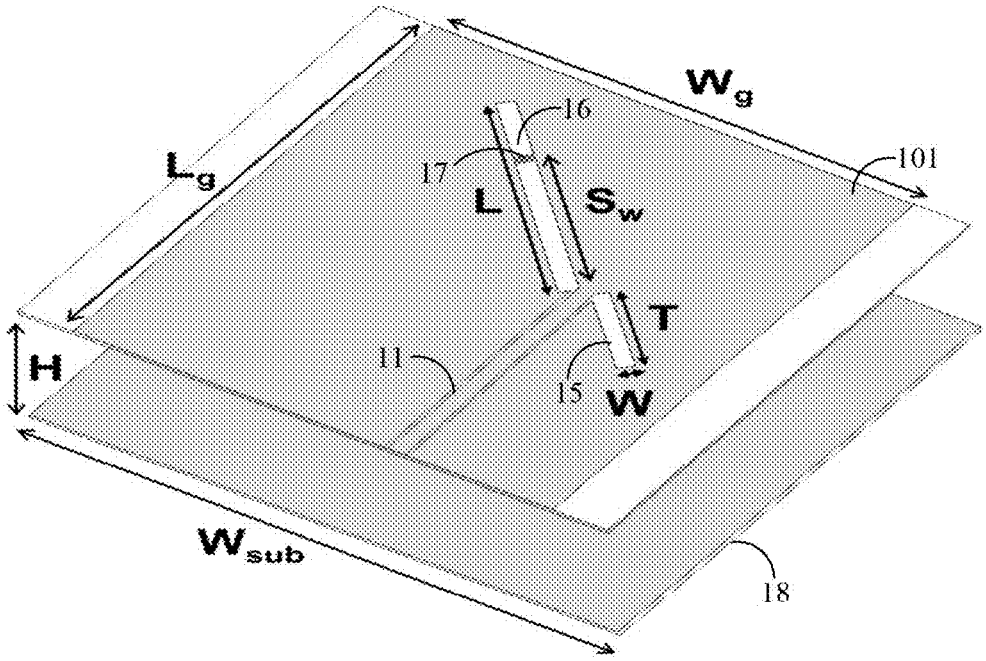
FIG. 9 is a structural schematic of an opening slot element and a terminal slot antenna in the second embodiment of the invention.

Please refer to FIG. 9, which is the structural schematic of the opening slot element 15 and terminal slot antenna 16 in the second embodiment of the invention. In the embodiment, the opening slot element 15 is a rectangular opening slot element, and the dimensions of the opening slot element 15 and terminal slot antenna 16 are as shown in Table 5.

TABLE 5

Geometric Dimensions and Parameters of Antenna

| $L_g$ | $W_g$ | $W_{sub}$ | H | L | $S_w$ | T | W |
|---|---|---|---|---|---|---|---|
| 96 | 87 | 107 | 30 | 51 | 34.19 | 20 | 3 |

(Unit: mm)

The aforementioned is the width of the opening slot element 15, where T is the length of the opening slot element 15, Lg is the length of the terminal 111 of the substrate 10, Wg is the width of the terminal 111 of the substrate 10, Wsub is the width of the reflective plate 18, H is the distance between the substrate 10 and the reflective plate 18, L is the length of the terminal slot antenna 16, Sw is the distance from the coplanar feed line 11 to the switch device 17 on the terminal slot antenna 16, and Sg is the spacing between the metal planes of the two sets of sub-antenna on the above and below.

Please refer to FIGS. 10~17, which are the simulation diagrams and measurement charts for the parameter S of the antenna groups with spacing d1~d4, feed port 110 (port 1), and the relative terminal 111 (port 2). S11 simulation diagram is the dotted line section of the square node. S11 measurement chart is the solid line section of the square node. S21 simulation diagram is the dotted line section of the circular node. S21 measurement chart is the solid line section of the square node. S22 simulation diagram is the dotted line section of the square node. S22 measurement chart is the solid line section of the square node. S12 simulation diagram is the dotted line section of the circular node. S12 measurement chart is the solid line section of the square node. The parameters are as shown in Table 6.

TABLE 6

Description of Parameters in Figures

Figure 10:
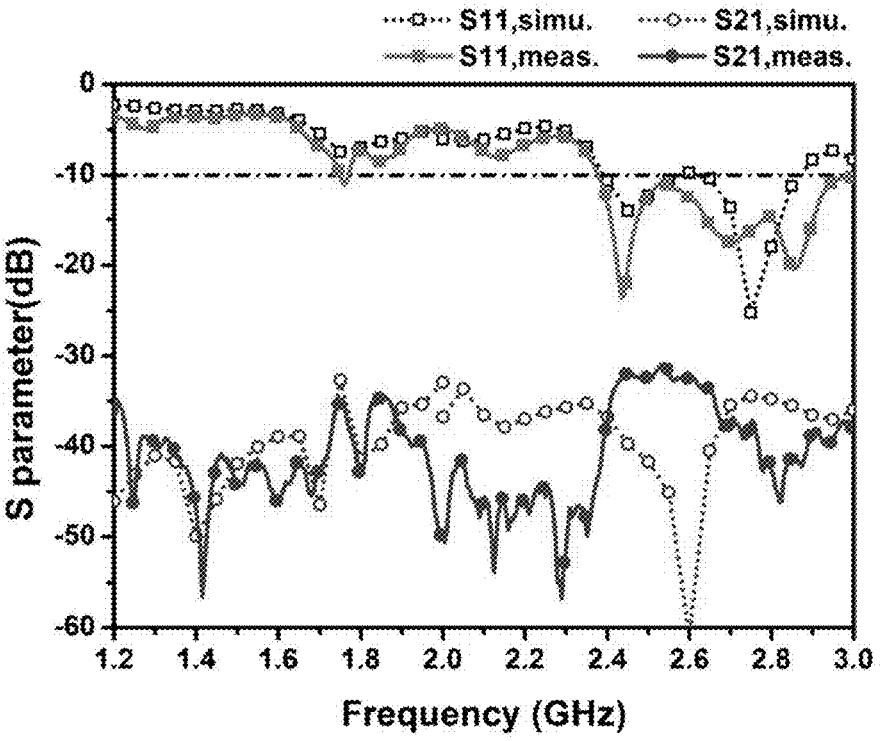
FIG. 10~FIG. 17 are simulation diagrams and measurement charts of the parameter S of a feed line end relative to a terminal within the spacing between each antenna in the second embodiment of the invention.
Figure 11:
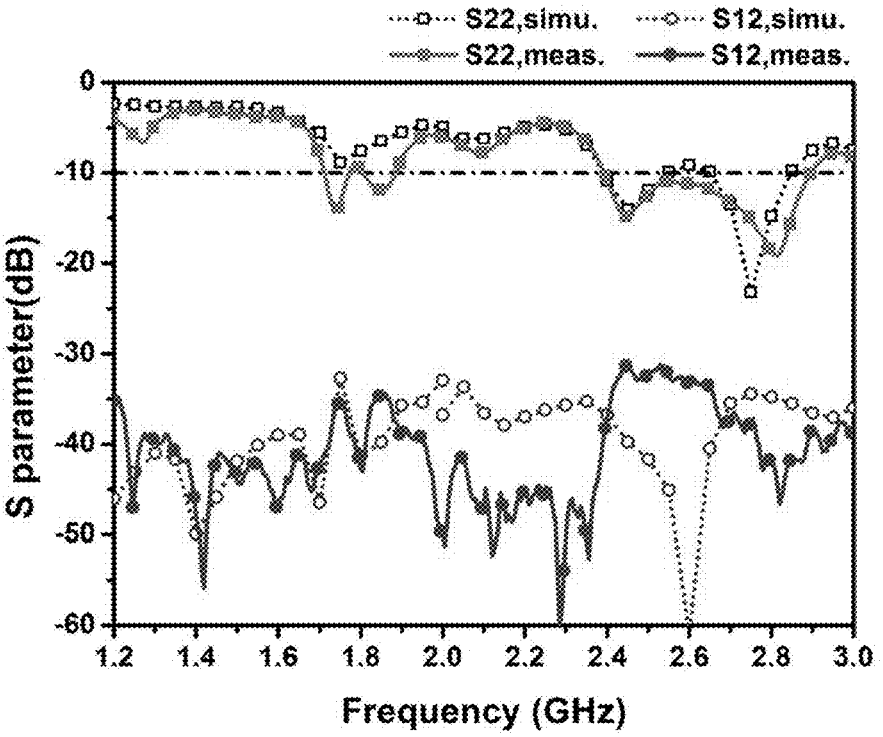
Figure 12:
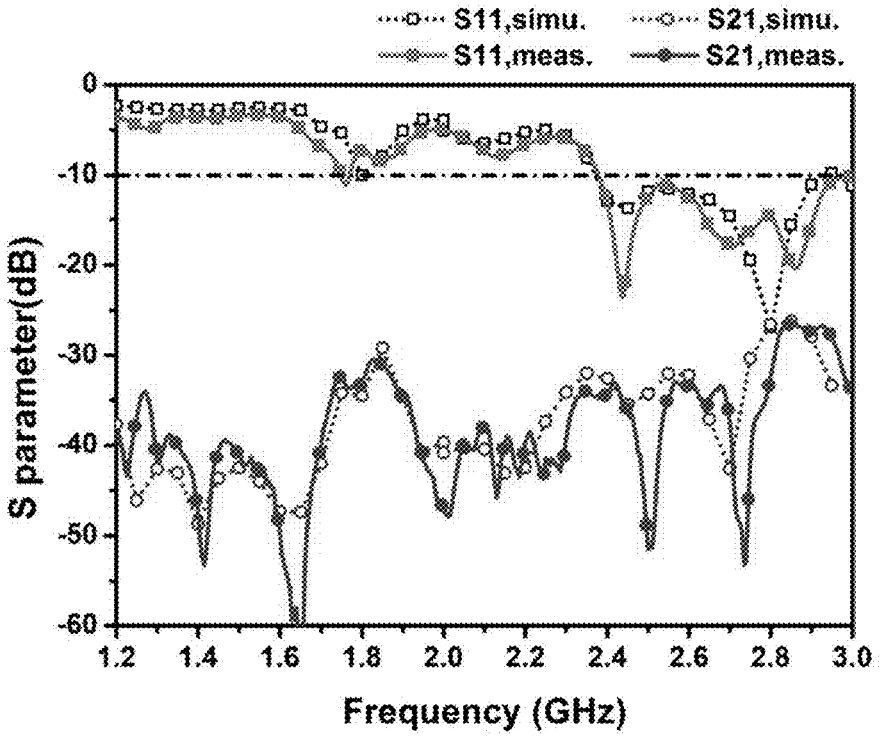
Figure 13:
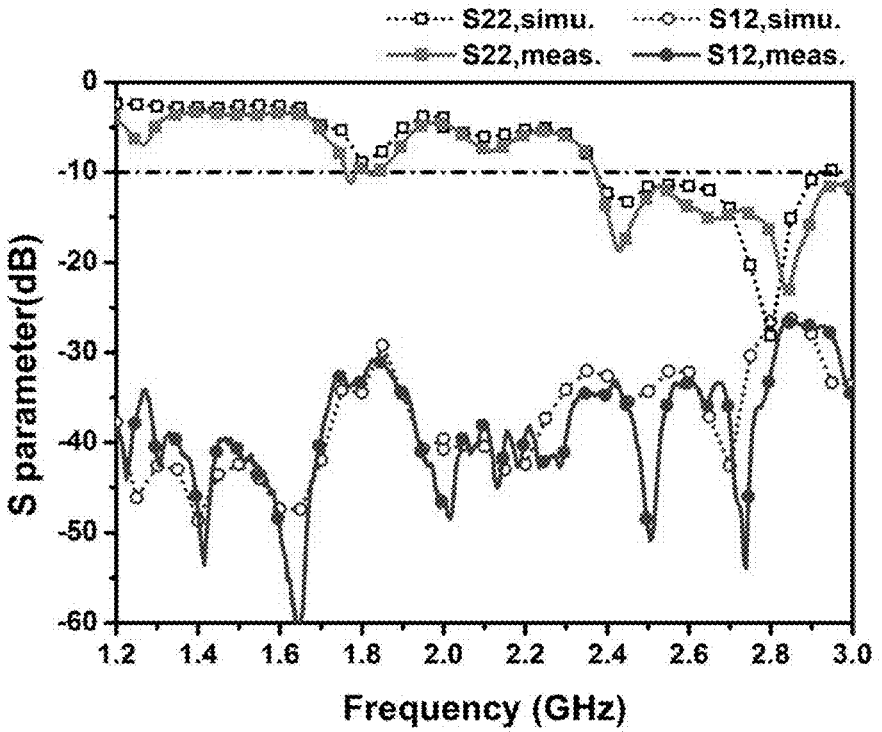
Figure 14:
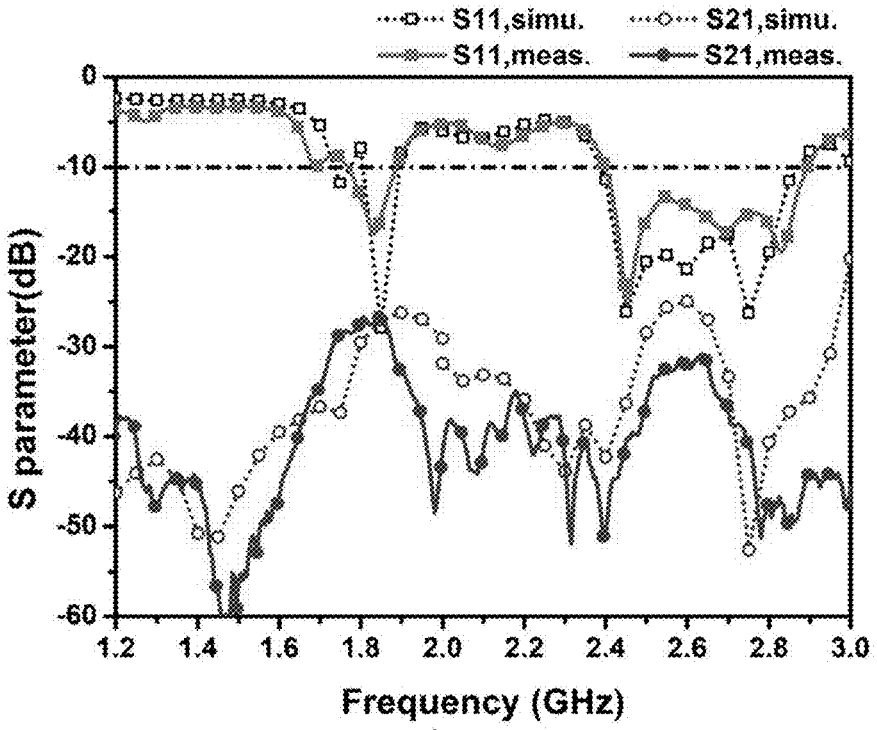
Figure 15:
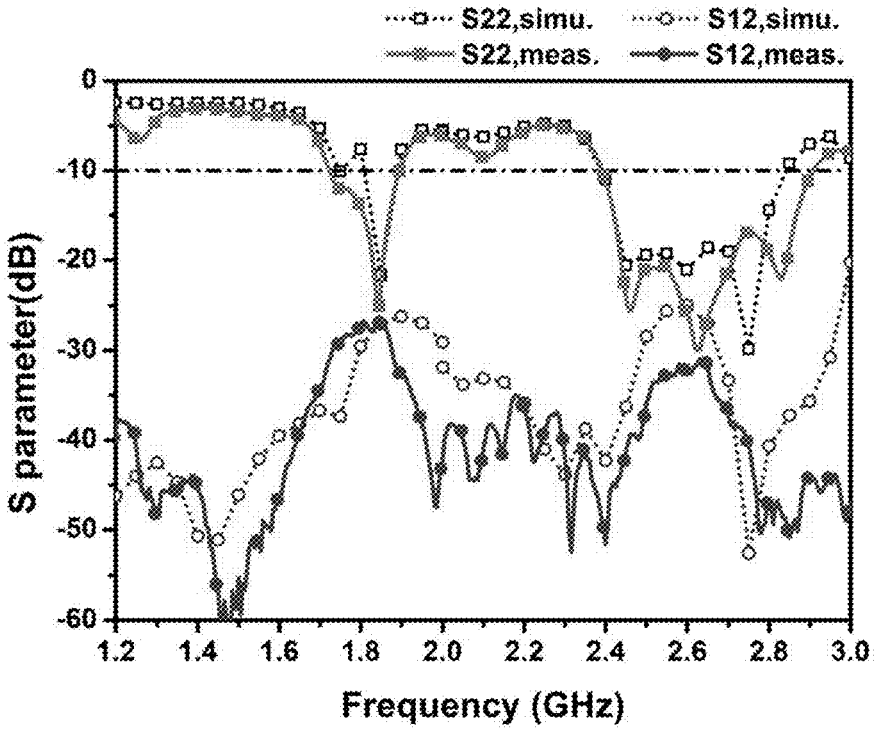
Figure 16:
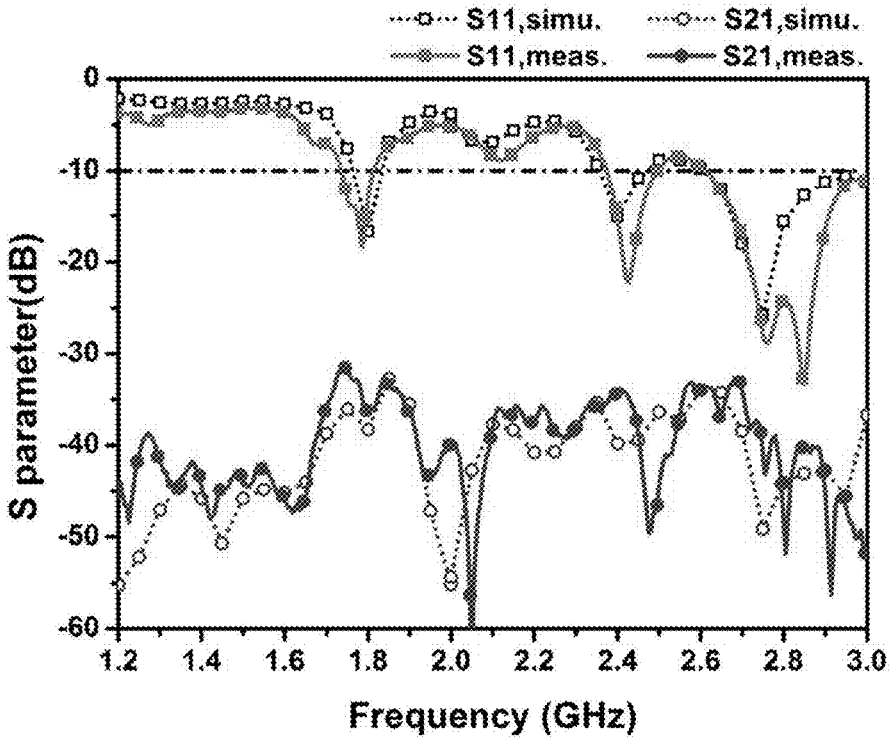
Figure 17:
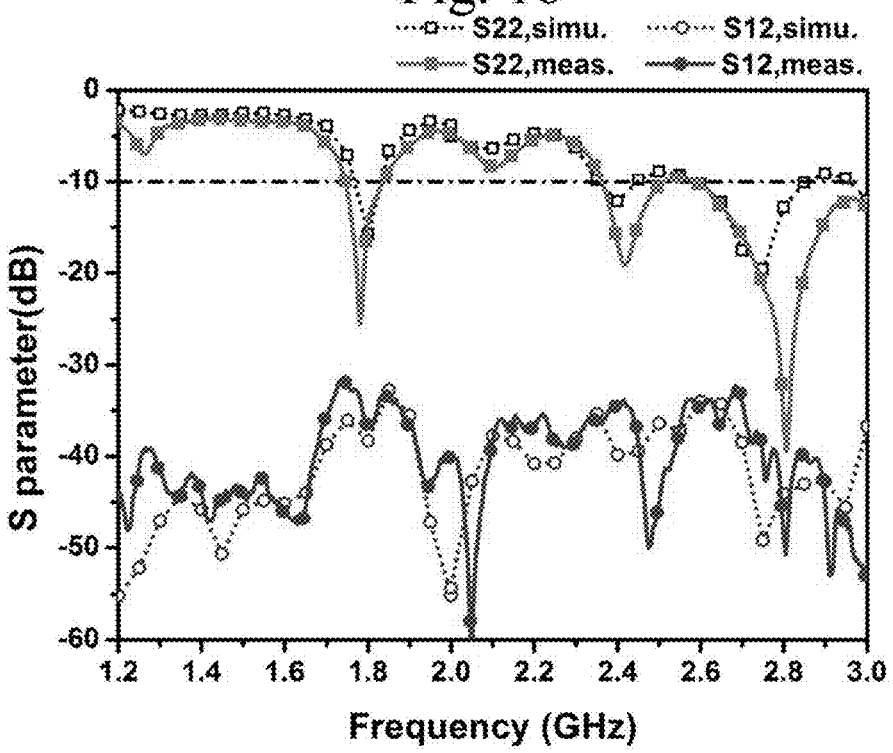

| FIG. | Antenna Spacing | Parameter S |
|---|---|---|
| FIG. 10 | d1 | S11 ` S21 |
| FIG. 11 | d1 | S22 ` S12 |
| FIG. 12 | d2 | S11 ` S21 |
| FIG. 13 | d2 | S22 ` S12 |
| FIG. 14 | d3 | S11 ` S21 |
| FIG. 15 | d3 | S22 ` S12 |
| FIG. 16 | d4 | S11 ` S21 |
| FIG. 17 | d4 | S22 ` S12 |

Through the adjustment of the geometric length of the two sets of slot antenna 12 or the location of the switch device 17 on the slot antenna 12, the electronic switching beamforming antenna array 1 in the second embodiment can possess dual band (1800 MHz and 2600 MHz) operation characteristics. Please refer to FIG. 18~FIG. 21, which are the field type schematics of the high frequency (2600 MHz) antenna groups of the electronic switching beamforming antenna array 1 in the second embodiment of the invention. The dotted line section of the square node is the simulation diagram, while the solid line section of the square node is the measurement chart. For the convenience of explanation, the second embodiment of the invention will only be conducted in high frequency fields for explaining. However, the electronic switching beamforming antenna array 1 also possesses the ability to change beamforming directions at low frequencies. The description of parameters of the antenna groups and their relative diagrams are as shown in Table 7.

TABLE 7

Figure 18:
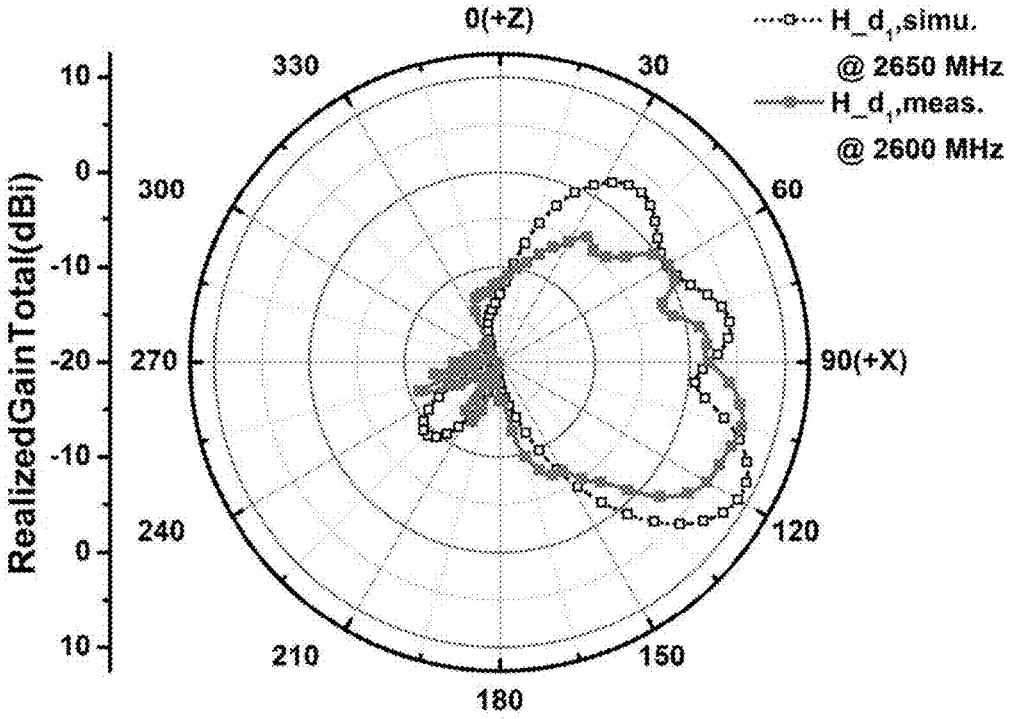
FIG. 18~FIG. 21 are field type schematics of antenna groups in the electronic switching beamforming antenna array in the second embodiment of the invention.
Figure 19:
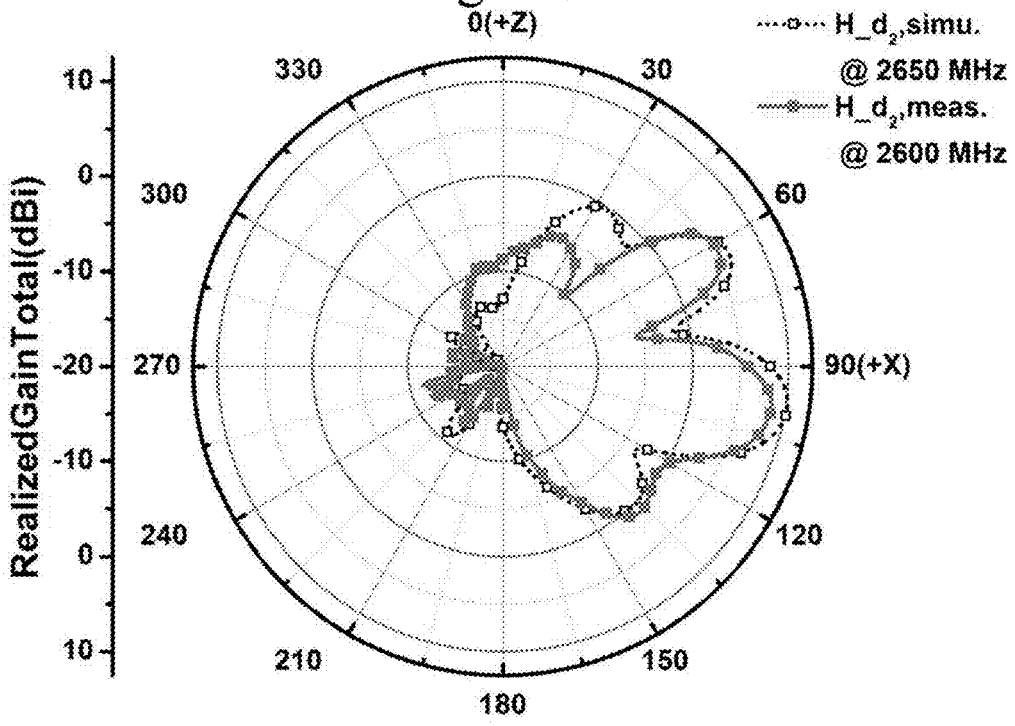
Figure 20:
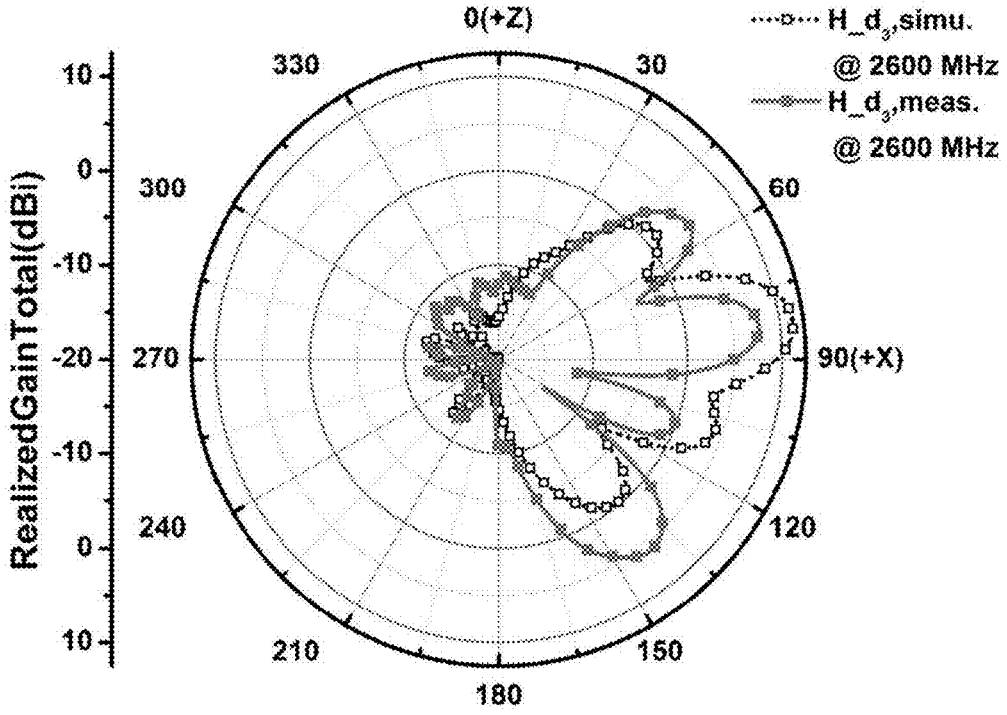
Figure 21:
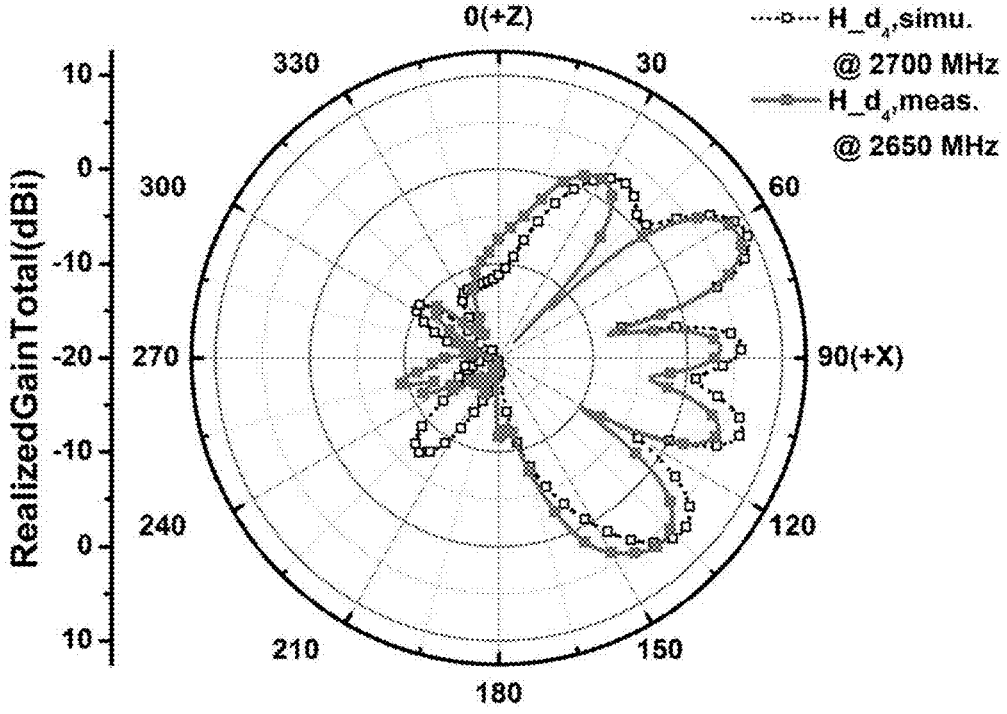

| FIG. | Antenna Spacing |
|---|---|
| FIG. 18 | d1 |
| FIG. 19 | d2 |
| FIG. 20 | d3 |
| FIG. 21 | d4 |

Figure 22:
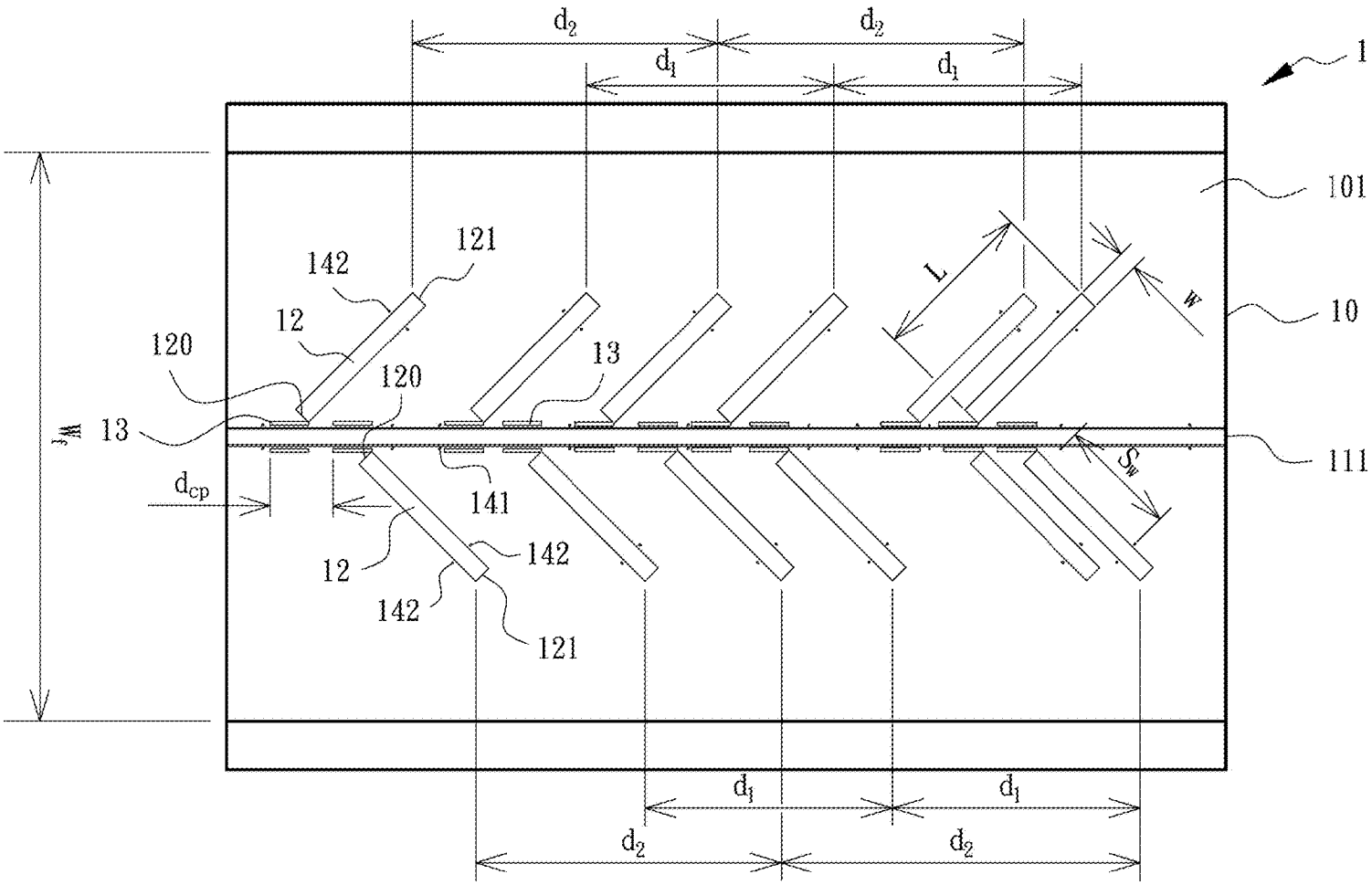
FIG. 22 is a structural schematic of the electronic switching beamforming antenna array in the third embodiment of the invention.

Please refer to FIG. 22, which is the structural schematic of the electronic switching beamforming antenna array 1 in the third embodiment of the invention. The third embodiment is similar to the first embodiment but the difference lies in that the slot antenna 12 is installed on the two sides of the coplanar feed line 11 in the third embodiment to configure the polarization characteristics of the antenna (linear polarization, circular polarization, etc.). To further explain, when the linear polarization characteristic is needed, the slot antenna 12 relates to the corresponding configuration on both sides of the coplanar feed line 11. When circular polarization is needed, the slot antenna 12 relates to the interleaved configuration on both sides of the coplanar feed line 11. The geometric parameters (circular polarization configuration) of the third embodiment are as shown in Table 8, where dcp is the spacing between the slot coupling segments 13.

TABLE 8

| Geometric Parameters of Circular Polarization Antenna (Unit: mm) | | | | | |
|---|---|---|---|---|---|
| $d_{cp}$ | L | W | $S_w$ | $d_1$ | $d_2$ |
| 13 | 34 | 3.8 | 26 | 51 | 63 |

Please refer to FIGS. 23~26, which are the field maps of the antenna groups with spacing d1 and d2. The dotted line section of the circular node is the field map of the left-hand circular polarization (LHCP), while the solid line of the circular node is the field map of the right-hand circular polarization (RHCP). From the field maps, it is proven that the antennas in the third embodiment of the invention possess circular polarization antenna features. The details of the field maps are as shown in Table 9.

TABLE 9

Figure 23:
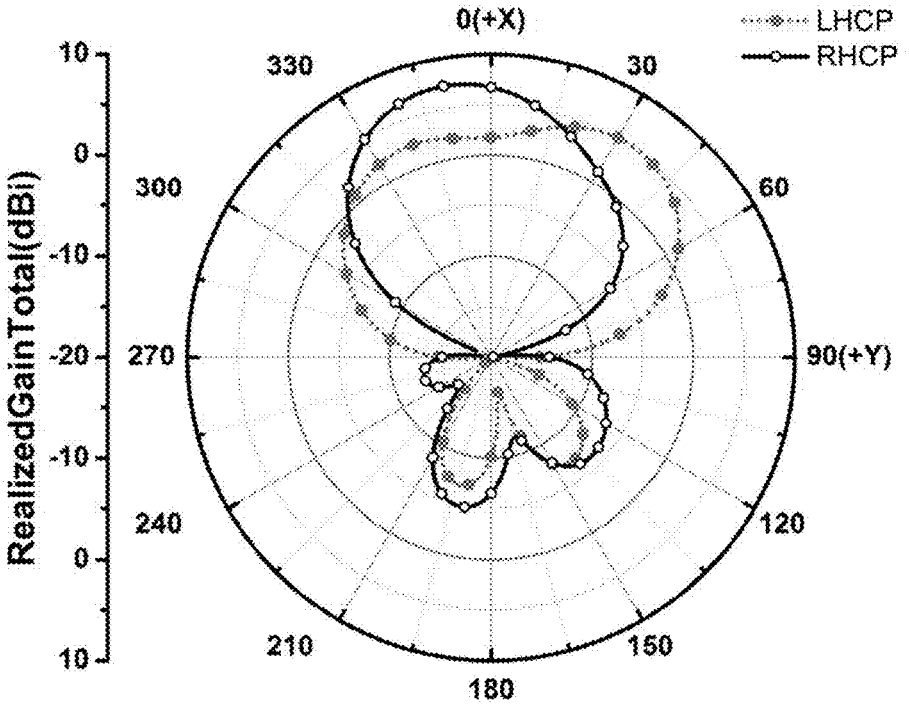
FIGS. 23~26 are field maps of circular polarization in the third embodiment of the invention.
Figure 24:
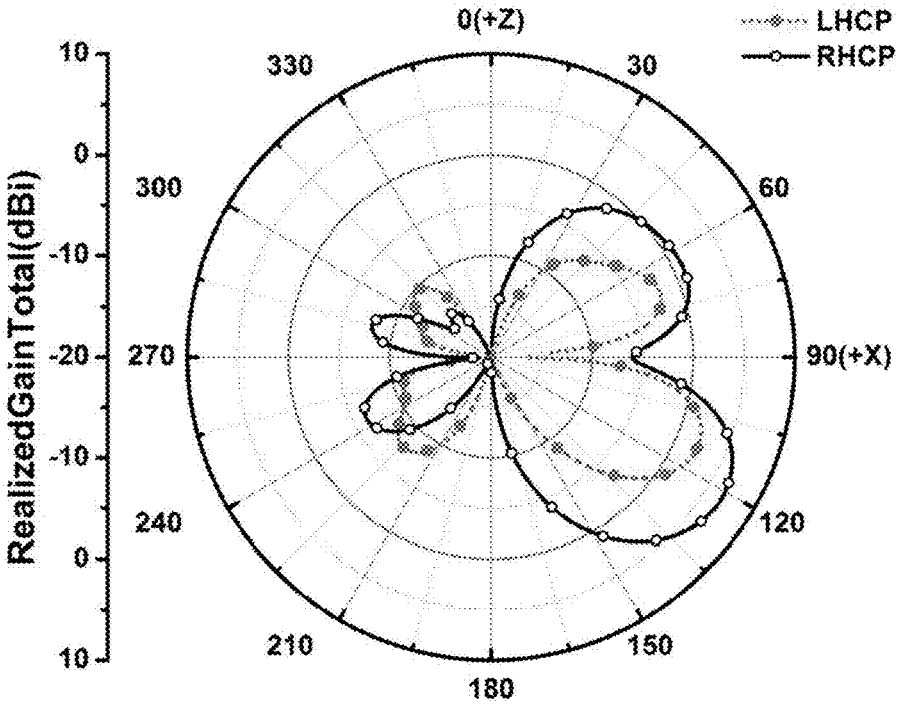
Figure 25:
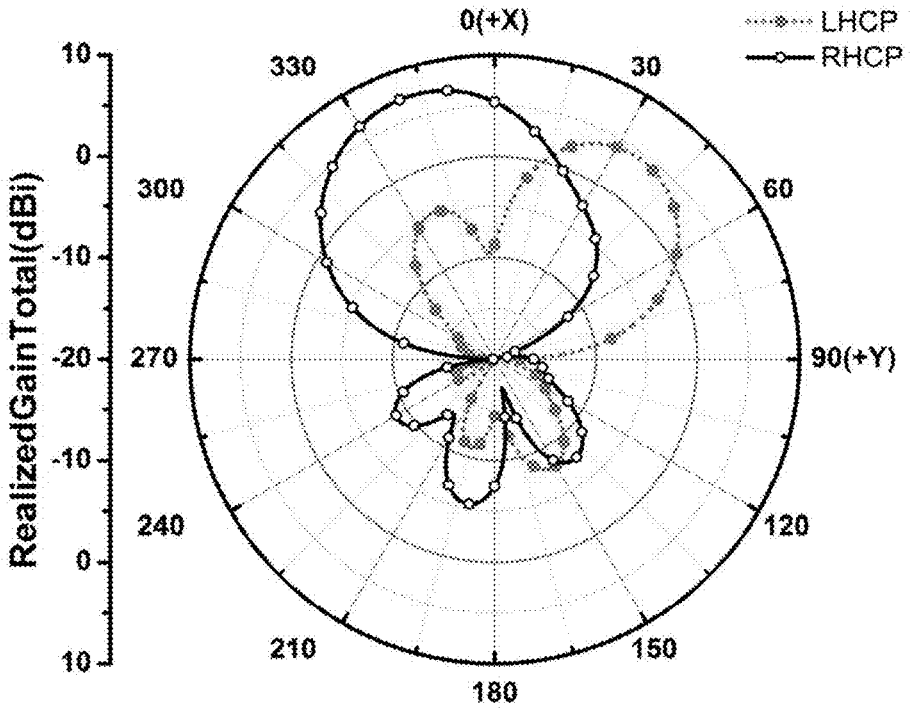
Figure 26:
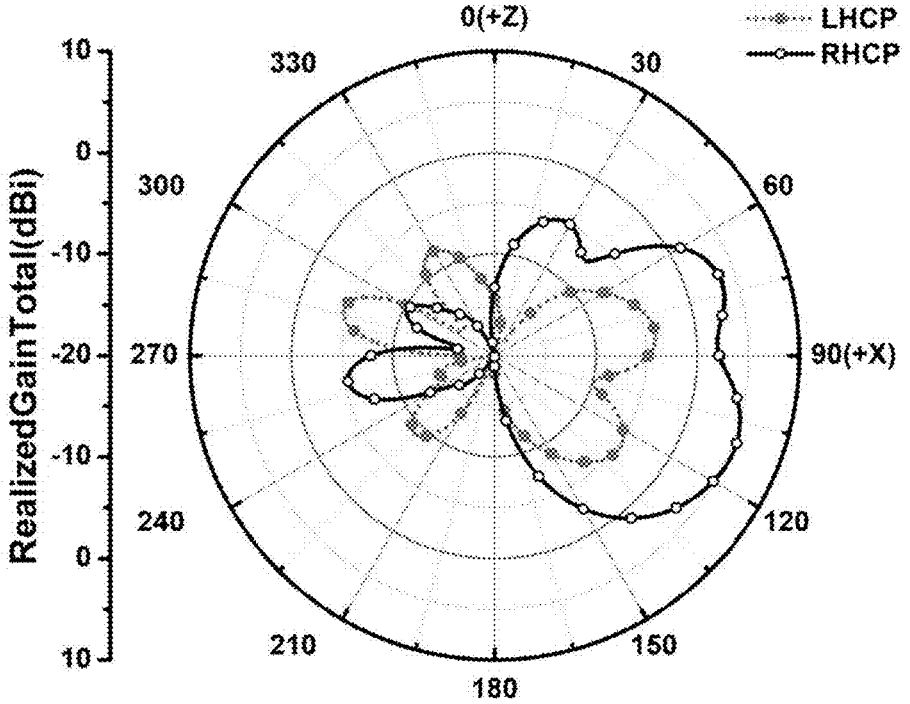

| FIG. | Antenna Spacing | Field Type |
|---|---|---|
| FIG. 23 | d1 | XY Plane (Horizontal Plane) |
| FIG. 24 | d1 | XZ Plane (Vertical Plane) |
| FIG. 25 | d2 | XY Plane (Horizontal Plane) |
| FIG. 26 | d2 | XZ Plane (Vertical Plane) |

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. An electronic switching beamforming antenna array, comprising:

a coplanar feeding line, configured on a metal plane of a substrate; and a plurality of slot antennas, inclinedly configured on the metal plane, and configured on at least one side of the coplanar feeding line, each slot antenna comprising:

a slot coupling segment, configured at one end of the each slot antenna and neighbored with the coplanar feeding line so as to make the each slot antenna couple with the coplanar feeding line; and a switch device, configured at one portion between one part of the each slot antenna and a grounding plane formed by the metal plane;

wherein the switch device of the each slot antenna is triggered to configure a radiating feature of the each slot antenna so as to set beamforming direction of the electronic switching beamforming antenna array;

wherein a terminal of the coplanar feeding line comprises a fan-shaped opening slot element and a terminal slot antenna, and a signal current affected by the fan-shaped opening slot element is flowed towards the terminal slot antenna.

2. The electronic switching beamforming antenna array as claimed in claim 1, wherein the slot antennas are configured at two sides of the coplanar feeding line.

3. The electronic switching beamforming antenna array as claimed in claim 2, wherein the slot antennas are interleavedly configured at two side of the coplanar feeding line.

4. The electronic switching beamforming antenna array as claimed in claim 1, wherein the coplanar feeding line comprises a first coplanar feeding line and a second coplanar feeding line, and the slot antennas are configured at one side of the first coplanar feeding line and the second coplanar feeding line, respectively.

5. The electronic switching beamforming antenna array as claimed in claim 1, wherein the slot antennas are symmetrically set along the coplanar feeding line as an axis of symmetry.

6. The electronic switching beamforming antenna array as claimed in claim 1, further comprising at least one crossing line that connects the ground planes separated by the coplanar feeding line.

7. The electronic switching beamforming antenna array as claimed in claim 1, wherein longitudinal axes of the slot coupling segments are parallel with a longitudinal axis of the coplanar feeding line.

8. The electronic switching beamforming antenna array as claimed in claim 1, wherein the slot antennas are extended from the coplanar feeding line to the terminal of the coplanar feeding line.

9. The electronic switching beamforming antenna array as claimed in claim 8, wherein the slot antennas are interleavedly configured into a plurality of antenna groups by spacing.

10. An electronic switching beamforming antenna array, comprising:

a coplanar feeding line, configured on a metal plane of a substrate; and a plurality of slot antennas, inclinedly configured on the metal plane, and configured on at least one side of the coplanar feeding line, each slot antenna comprising:

a first slot coupling segment, neighbored with the coplanar feeding line;

a second slot coupling segment, configured at one end of the each slot antenna and neighbored with the coplanar feeding line so as to make the each slot antenna couple with the coplanar feeding line; and a switch device, configured at one portion between one part of the each slot antenna and a grounding plane formed by the metal plane;

wherein the switch device of the each slot antenna is triggered to configure a radiating feature of the each slot antenna so as to set beamforming direction of the electronic switching beamforming antenna array;

wherein a terminal of the coplanar feeding line comprises a fan-shaped opening slot element and a terminal slot antenna, and a signal current affected by the fan-shaped opening slot element is flowed towards the terminal slot antenna.

11. The electronic switching beamforming antenna array as claimed in claim 10, wherein longitudinal axes of the first and second slot coupling segments are parallel with a longitudinal axis of the coplanar feeding line.

* * * * *